United States Patent [19]

Delatorre et al.

[11] Patent Number: 4,624,136

[45] Date of Patent: Nov. 25, 1986

[54] DOWN HOLE POWER CONVERSION MEANS FOR FULLY UTILIZING BATTERIES

[75] Inventors: Leroy C. Delatorre, Sugarland; Homer M. Wilson, Houston, both of Tex.

[73] Assignee: Panex Corporation, Sugarland, Tex.

[21] Appl. No.: 718,111

[22] Filed: Mar. 29, 1985

[51] Int. Cl.[4] ..... E21B 49/00

[52] U.S. Cl. ..... 73/152

[58] Field of Search ..... 73/152, 154; 323/222; 340/636

[56] References Cited

U.S. PATENT DOCUMENTS

| | | | |
|---|---|---|---|
| 3,523,239 | 8/1970 | Heard | 323/222 |
| 4,008,429 | 2/1977 | Phalan | 323/222 |
| 4,033,186 | 7/1977 | Bresie | 73/154 |
| 4,195,349 | 3/1980 | Balkanli | 73/152 |
| 4,349,776 | 9/1982 | Federico et al. | 323/222 |
| 4,413,224 | 11/1983 | Krupka et al. | 323/222 |
| 4,536,700 | 8/1985 | Bello et al. | 323/222 |

*Primary Examiner*—Stewart J. Levy
*Assistant Examiner*—Robert R. Raevis

[57] ABSTRACT

A self-contained, down hole powered electrical system in which the available power of a battery source is matched by a power conversion means to the power required in the down hole equipment and the power conversion means provides a regulated voltage output.

5 Claims, 5 Drawing Figures

DOWN HOLE POWER CONVERSION MEANS FOR FULLY UTILIZING BATTERIES

Field Of The Invention

This invention relates to oil field tools, and more particularly to down hole power systems for self-contained oil field tools used for measuring down hole parameters such as pressure and temperature over long periods of time.

BACKGROUND OF THE INVENTION

In many types of operations conducted in an oil well or well bore, instrumentation is lowered into the well bore on either an electrical wireline, a slickline or tubing to obtain measurements of one or more down hole parameters such as pressure or temperature as a function of time. Typically, these measurements are transmitted (where a wireline cable is involved) to the surface of the earth for processing, recording and subsequent analysis. Similarly, electrical power requirements for the instrumentation are transmitted from the surface to the down hole instrumentation. In many instances, however, it is desired to have a down hole, self-contained power system for operation of the down hole instrumentation and recording data relative to the measurement parameters. In still other instances, the down hole instrumentation may be left in the well bore for a prolonged period of time to obtain a series of down hole measurements over the prolonged period of time for evaluation purposes. To obtain the down hole power required for the instrumentation it is common to use D.C. batteries (dry cells) which can be specially manufactured or purchased from commercially available battery sources.

In production logging types of equipment for oil field use it is common to take down hole pressure and temperature measurements over a period of time and typically such instrumentation is in a small diameter range such that size C batteries and sometimes smaller batteries are used for the down hole D.C. power supply. The tool configuration typically has an outer diameter sized to pass through a production tubing. As a consequence, the batteries are typically series connected in the tool housing similar to a flashlight battery connection.

Where high temperatures are involved (say above 212° F.), the commercially available batteries are silver oxide and are relatively expensive, a size C battery presently costing about $60.00 a unit. A typical D.C. battery is rated in terms of ampere-hour life for a given voltage. In other words, the battery will provide a certain amount of current for a certain amount of time at a certain voltage before it expires. However, one of the problems in a D.C. battery is the fact that as the battery life is being used, the voltage output capacity of the battery tends to decrease.

In any event, in a typical oil field production test of temperature and pressure, the cost of the operation relative to the cost of batteries is high. As a consequence, it is common to use a fresh set of batteries for each independent operation so that the reliability of the tool during the time required for the down hole measurements is assured. This is a safety factor since used batteries in subsequent use may become defective during the operation. Also, recycling of batteries between high temperature and lower temperatures for different operations tends to cause battery failure when subsequently used. As a consequence, a new set of batteries is used for each operation and this can be a significant and expensive operating cost for use of the equipment and increases the overall cost of the operation.

The present invention concerns itself with a system for minimizing the number of D.C. batteries required in a self-contained down hole tool to provide adequate voltage and current for the measurement of time. In the use of the system, the number of batteries used is the minimum required for a given operation and the batteries will be completely utilized in a manner which compensates for the loss of voltage over the life of the battery and yet maintains a regulated voltage output for operation of equipment for a defined period of time.

Prior art patents which are related to the type of equipment contemplated by the present invention are:

| U.S. Pat. No. | Issued | Inventor |
|---|---|---|
| 4,033,186 | 7/05/77 | Bresie |
| 4,161,782 | 7/17/79 | McCracken |

THE PRESENT INVENTION

The present invention relates to a self-contained down hole tool for use in a production well for measuring pressure and temperature over prolonged periods of times. Production tools of this type are powered by D.C. batteries. In the present invention, the electrical power required by the equipment, i.e. the voltage and current required as a function of time, is determined and matched to the minimum number of batteries to be used to fully expire the current and time life of the batteries at their rated voltage. Thus, the electrical power available from the batteries is matched to the power required for operation of the equipment down hole for the measurement time period. To accomplish this, a low loss power conversion means converts the battery power to a regulated voltage source which provides current as necessary to the equipment.

To determine the power load for the down hole equipment, the power load is the product of the current required for operation of the equipment times the time required for the current usage times the required equipment voltage. To determine the battery power requirements, the product of the equipment current, voltage and time is divided by the product of current available from the battery times the time life of the battery which provides the battery voltage required for the system. By dividing the battery voltage required by 1.5 volts, or the battery voltage, the number of D.C. batteries required can be determined.

In the equipment, power conversion means are provided to provide a regulated output voltage to the equipment and to maintain the regulation of the required voltage as a function of current required by the equipment.

One circuit means for accomplishing power conversion and voltage regulation includes a low loss inductor for storing energy and a capacitance for providing a regulated voltage. By comparing the regulated voltage output to a reference voltage, the inductance can be caused to discharge its energy into the capacitor and upon regulating the voltage, can build up energy from the batteries when the capacitor is fully charged to the regulated voltage.

DESCRIPTION OF THE PRESENT INVENTION

Figure 1:
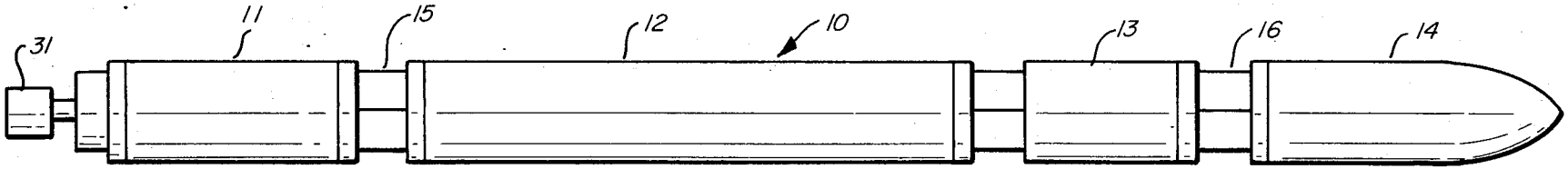
FIG. 1 is a view of a tool embodying the present invention.
Figure 2:
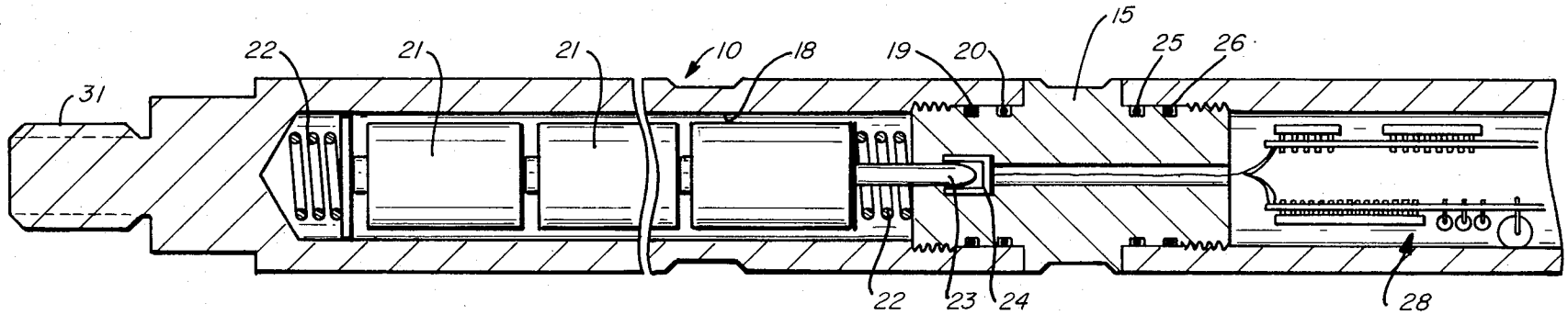
FIGS. 2 and 3 are views in cross section of parts of the tool of FIG. 1.
Figure 3:
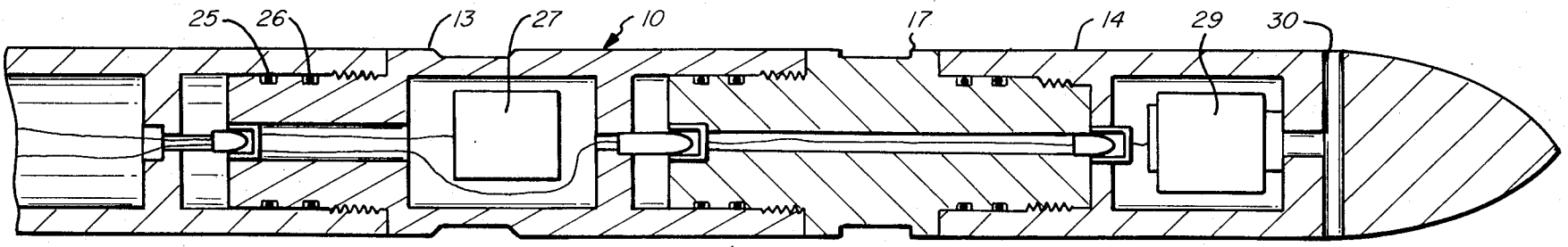

With reference to FIGS. 1–3, the down hole tool 10 of this invention is sized for insertion through the production tubing of an oil or gas well on a line, e.g. cable, tube to the desired depth in a well bore. At the selected depths for measurements, pressure and temperature sensors in the tool 10 which are exposed to well ambient conditions, are activated at preselected intervals. Signals from these sensors are processed and stored electronically within the tool 10 for retrieval and display above the surface using a surface read-out unit (not shown) suited for this purpose.

The down hole tool 10 of this invention is comprised of a plurality of generally tubular housings 11, 12, 13, 14 connected to one another by generally solid connector sections 15 and 16 to form an integral, elongated assembly.

The battery housing 11 is at the upper end of the tool 10, and the open end of the battery housing 11 is closed by a connector section 15 which is press-fitted or threaded to the inner surface 18 of the tubular battery housing 11. O-rings 19 in grooves 20 slidably press on the inner surface 18 of the battery housing 11 thereby providing a liquid and moisture seal to exclude substances such as oil, water or gas from entering the battery housing 11. Keying devices (not shown) may be used to assure a preferred alignment between the connector 15 and the battery housing 11. Within the battery housing 11 are a plurality of electric storage batteries 21, e.g. dry cells, furnishing the direct current (DC) power which energizes the data and control circuits. The force of springs 22 assures good contact between batteries 21, and at the battery end terminals. One end terminal is connected to a banana plug 23 which is received in a connector plug 24. The connector plug 24 is connected to a D.C. power lead which passes through the connector section 15 and extends into the other tool compartments for connection to other electrical circuit elements. Location of the batteries 21 at one end of the tool 10 allows removal and exchange of exhausted batteries 31 without any need to disassemble the remainder of the tool.

The midsection of the down hole tool is a tubular housing 12 which is joined to the connector 15 and to the connector 16 by a seal means similar to that described above comprised of O-rings 25 and grooves 26. The temperature sensor 27 and electronic circuit elements generally indicated by number 27 are maintained in the housing 13 and sealed against the external environment by the connector housing 13 which joins to the housing 12 with O-rings and grooves as described above. The electronic circuit elements 28 within the control housing 12 include printed circuit boards, integrated circuits, and conventional commercially available electronic components. The connector section 17 interconnects the housing 13 and pressure housing 14. In the pressure housing 14 a pressure transducer 29 has access to the fluid exterior of the housing by means of a passageway 30. Banana plugs and connectors are provided for interconnection and electrical leads are passed to the control housing 12.

The control housing 12 is a tubular member threadably attached to the housing 13 and sealed against the external ambient environment by O-rings in grooves as described above. The closed end of the housing 13 away from the connector 15 is the upper end of the assembled tool 10 as it decends into the well shaft. Attachment means (generally indicated as number 31) provide for connection of the wireline or cable (not shown) on which the tool is lowered and raised in the well.

The temperature sensor 27 in the housing 13 produces an electrical signal as a function of temperature, and can be, for example, a thermocouple or temperature sensitive resistor used in an oscillator circuit. The housing 13 is fabricated of thermally conductive material such that the temperature sensor 27 is responsive to the external ambient temperature.

In respect to the considerations involved for the present invention, a commonly available silver oxide 1.5 volt D.C. battery is rated to provide a certain amount of current for a certain amount of time. If fourteen 1.5 volt batteries are connected in series where each battery has a rated current/hour life of 0.01 amps for 96 hours, then there are 20.16 volt ampere hours of total power available from the battery pack. The down hole battery pack will provide 21 volts as the voltage source. If the equipment requires a 20 volt source for 96 hours but only uses or requires 0.0048 amps then the down hole battery pack utilizes 9.216 volt ampere hours of total power which is considerably less than the 20.16 volt ampere hours that are available. In other words, to obtain the required 20 volt source down hole, a substantial number of expensive batteries are required which are not fully utilized. Because remaining life of used batteries is not predictable it is common to use new batteries for each separate operation.

The above relationship of volt ampere hours may be expressed as follows:

| Voltage Required Downhole | | Current Required Downhole | | Hours of Use | | Total Power Consumed |
|---|---|---|---|---|---|---|
| 20 volts | × | 0.0048 amps | × | 96 hours | = | 9.216 |

However, if the maximum current life (0.01 amps) of the battery can be completely used, then the number of down hole batteries can be reduced as follows:

$$6 \text{ volts} \times 0.01 \text{ amps} \times 96 \text{ hours} = 9.216$$

In other words, if the voltage of the down hole battery pack can be reduced to 6 volts, only four batteries are required and they can be fully used over their entire life of 0.01 amps for a 96 hour period.

If the equipment requires 20 volts for 48 hours and uses 0.0048 amps then the equipment power requirement is:

$$20 \text{ volts} \times 0.0048 \text{ amps} \times 48 \text{ hours} = 4.608$$

The number of batteries requires is:

3 volts×0.01 amps×48 hours=4.608 or 2 batteries at 1.5 volts each.

The present invention concerns itself with a system for utilizing the least number of batteries for the equipment power load.

As shown in FIG. 1, a typical production logging tool 10 has a housing sized for passage through a production tubing in a well bore to a level where a test is desired. The tool is lowered into and retrieved by a wireline. In the type of tool contemplated by the present invention in the tool housing is a power source comprised of 1.5 volt D.C. batteries in series connection. While series connection is the simplest form parallel arrangements of the batteres can be arranged, if desired. The batteries are stacked in line in the housing and provide available power of the voltage of the batteries times the rated current life of the batteries times the current life of the batteries at their rated voltage. The available power of the batteries is supplied to a power conversion means. The power conversion means is connected to the electrical equipment in the housing. The power conversion means is an electrical device to provide a high efficiency power conversion without significant dissipation of power. It also provides a constant voltage output and serves as an active voltage regulator. The purpose of the power conversion means is to convert battery power to equipment power where the battery power is material to the equipment power requirements.

Figure 4:
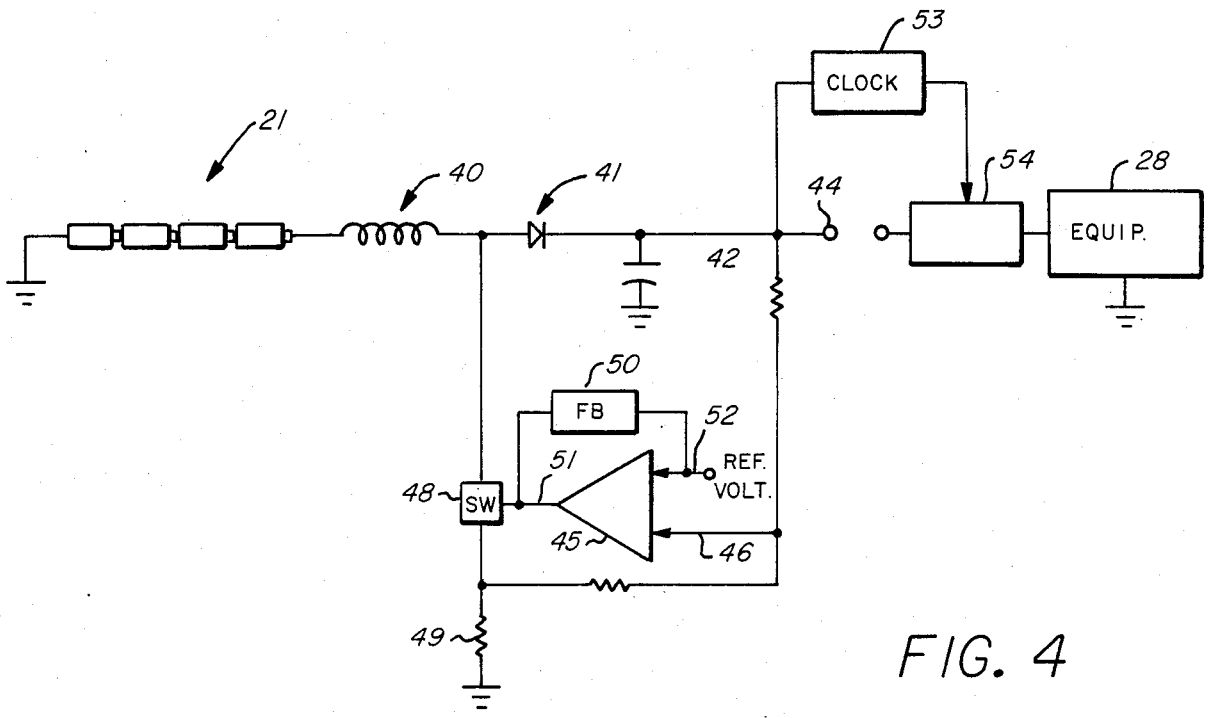
FIG. 4 is a schematic representation of electronic means used in the present invention.

Referring now to FIG. 4, an example of a power conversion means is illustrated. In FIG. 4, four 1.5 D.C. silver oxide batteries 21 are connected between an electrical ground and a high efficiency, low power loss inductance coil 40. The inductance coil 40 is connected by a diode 41 to a storage capacitor 42. The diode 41 and capacitor 42 are connected to an output 44 to supply a regulated voltage to the equipment 28 to be operated. A voltage comparison circuit 45 also receives an input 46 from the output 44 supplied to the equipment 28.

The comparison circuit 45 is coupled to an electronic switch 48. The switch 48 is connected between the diode 41 and inductor 40 and to a resistor 49 which is connected to a ground. A positive feedback circuit 50 is connected across the output voltage line 51 and the input line 52 to comparison circuit 45 to latch the switch in a given position. A reference voltage is also applied to the input line 52. A clock 53 operates a switch 54 to periodically actuate the equipment 28.

The foregoing circuit operates when the battery pack 21 is connected to the inductance 40. The clock operated switch 54 selectively couples the output 44 to the equipment 28 at desired time intervals for defined time periods. When the battery pack 21 is applied to the inductance 40, the capacitor 42 is charged up to the regulated voltage required by the equipment and current is supplied to the equipment 28 at the regulated voltage of the capacitor 42. When a reference input voltage on line 52 is exceeded by the voltage reference from the output 44, the comparison circuit 45 actuates the switch 48 to couple the inductance 40 to the resistor 49. When this occurs, the current flows into the inductance 40 until the switch 48 opens. The switch 48 opens when a predetermined current is obtained in the resistor 49 which indicates that the inductor is charged and ready to recharge the capacitor 42. Thereupon, current flows from the inductance 40 and the capacitor 42 is charged to the regulated voltage.

Figure 5:
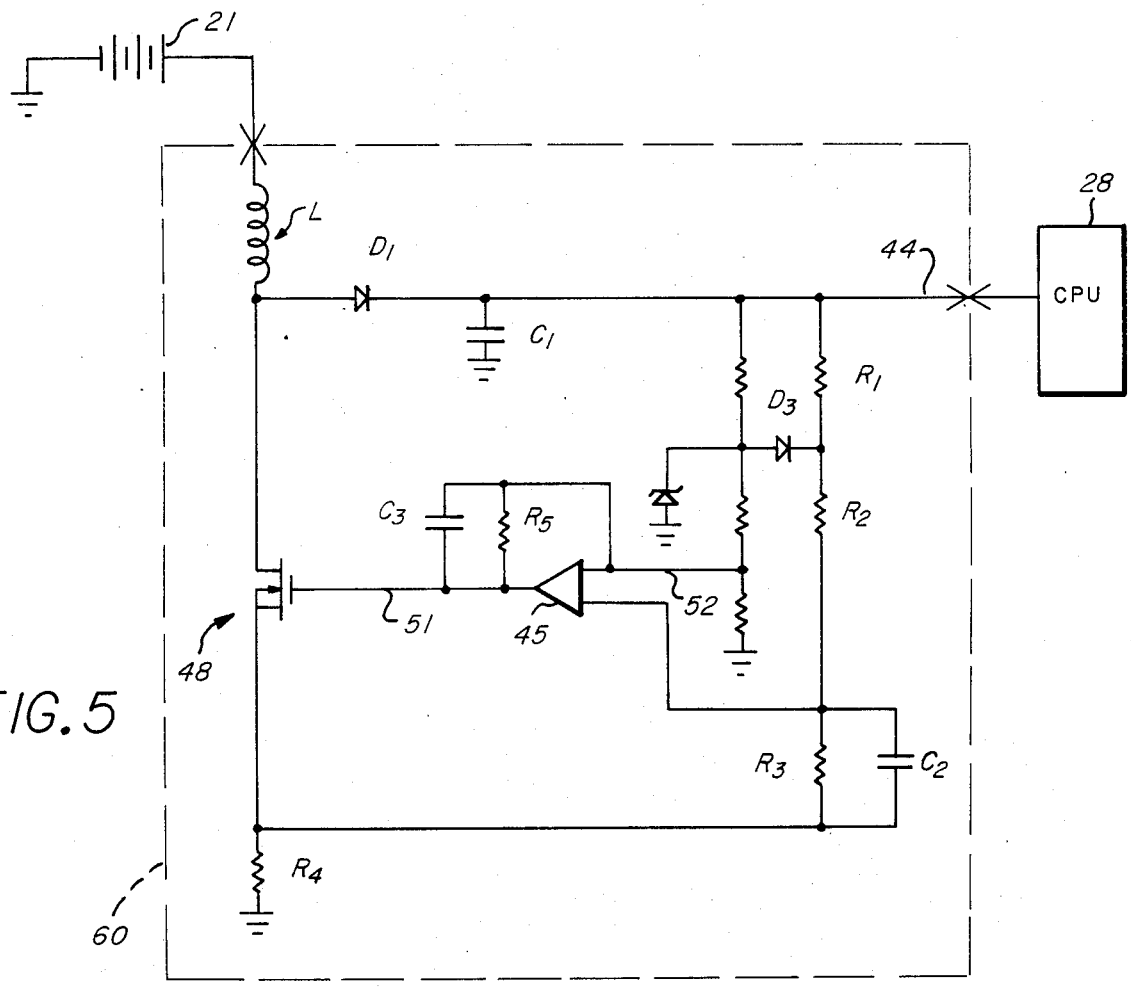
FIG. 5 is a schematic representation of an electronic circuit useful in the present invention.

Referring now to FIG. 5, the power conversion means for use with the present invention is illustrated in more detail for a steady state operation without a clock. The power conversion means 60 is shown in the dashed line as connected between a downhole CPU circuit means 28 to be operated and the battery source 21. The power conversion means 60 is adapted to regulate the voltage to the circuit means 28 independent of the voltage of the battery means 21.

In the power conversion means 60 is a first current path from the battery source 21 through current diode $D_1$ to an output 44 which connects to the circuit means 28 of the equipment. The output 44 is also connected to ground by a voltage divider network comprised of resistances $R_1$, $R_2$, $R_3$ and $R_4$. A low loss, high efficiency inductance L is coupled between the battery 21 and the resistor $R_4$ by a switch 48 which can be a field effect transistor. The regulated output voltage is obtained by a capacitance $C_1$ connected between ground and the diode $D_1$. When the battery source 21 is connected to the inductance L and the switch 48 is closed, then current flow through the inductance L causes a voltage buildup in the inductance L until the switch 48 is opened whereup the inductance charges the capacitor $C_1$ to a preset voltage of 20 volts or to the desired operating voltage determined by the capacitor $C_1$.

Regulation of the voltage on the capacitor $C_1$ is obtained by control of the switch 48. The switch 48 is controlled by the output voltage on an output line 51 of the comparison amplifier 45. The comparison amplifier 45 receives an input from the voltage divider network between resistors $R_2$ and $R_3$. This input provides a voltage input representative of the regulated output voltage. A reference voltage input is provided to line 52 by a voltage divider network which provides a precise reference voltage. A diode $D_3$ connects the reference voltage circuit to the resistor $R_2$ for start up purposes.

The switch means 48 is normally open and when the battery voltage is applied to the circuit, current is supplied to the circuit means 28 and establishes the reference voltage to the comparison amplifier 45. The difference in the reference voltage and the voltage to the input of the comparison amplifier 45 causes the switch means 48 to close so that current is supplied to the inductance L. When the inductance L is saturated, the switch 48 is opened by the comparison amplifier 45 so that the inductance then charges the capacitor $C_1$ to the 20 volt level. Thereafter, if the 20 volt output to line 44 drops, the comparison amplifier 45 is actuated to close the switch 48 and current is diverted into the inductance L until the switch 48 opens again. The capacitance $C_3$ and resistor $R_5$ are effective to compensate for the switching action to maintain the switch in a switched position.

The circuit is a regulator for providing a constant voltage without dissipating power. Basically the circuit converts voltage and current of the batteries over the life of the batteries to a regulated voltage output at the current requirement of the equipment. While the circuit illustrated steps up voltage of the battery source, the system concept is applicable to stepping down voltage, if desired.

It will be apparent to those skilled in the art that various changes may be made in the invention without departing from the spirit and scope thereof and therefore the invention is not limited by that which is enclosed in the drawings and specifications but only as indicated in the appended claims.

We claim:

1. In a down hole, self-contained oil tool for use in a well bore where such tool utilizes D.C. batteries as a source of power, housing means sized for passage through a well bore, said housing means carrying sensor means for sensing at least one down hole parameter and for providing electrical signals as a function of the parameter;

processing means in said housing coupled to said sensor means for processing said electrical signals where said processing means requires a defined amount of electrical operating current for a defined period of time at a defined regulated voltage level thereby defining a first power load relationship for a defined period of time, D.C. battery means in said housing means comprised of a number of battery units, each having a defined voltage capacity at a defined electrical current and time life, and power conversion means in said housing for coupling said battery means to said processing means and for converting electrical current at the voltage capacity of said battery means to electrical operating current at the regulated voltage level for operating said processing means, said battery units aggregatively having a voltage capacity, a defined electrical current and time life relationship which is substantially equal to the first power load relationship for a defined period of time so that the tool contains only the number of battery units required for supplying the first power load for the defined period of time.

2. In a down hole, self-contained oil tool for use in a well bore where such tool utilizes D.C. batteries as a source of power, housing means sized for passage through a well bore, said housing means carrying sensor means for sensing at least one down hole parameter and for providing electrical signals as a function of the parameter, processing means in said housing means coupled to said sensor means for processing said electrical signals where said processing means requires a defined amount of electrical current for a defined period of time at a defined regulated voltage level thereby defining a first power load for a defined period of time;

D.C. battery means in said housing comprised of a number of battery units, each having a defined voltage capacity at a defined electrical current life for a defined time life, and power conversion means in said housing for coupling said battery means to said processing means and for converting the defined voltage and the defined amount of electrical current for the time life available from said battery means to a voltage at a regulated level for said processing means for a defined time and current requirement for said processing means whereby the number of battery units required for operating a processing means is defined by the defined time of use of the processing means.

3. In a down hole, self-contained oil tool for use in a well bore where such tool utilizes D.C. batteries as a source of power, housing means sized for passage through a well bore, said housing means carrying sensor means for sensing at least one downhole parameter and for providing electrical signals as a function of the parameter;

processing means in said housing means coupled to said sensor means for processing said electrical signals where said processing means requires a defined amount of electrical current for a defined period of time at a defined regulated voltage level;

D.C. battery means in said housing means having a defined voltage at a defined electrical current life for a defined time life, said battery means being comprised of at least "N" number of batteries each having voltage value of "Vb" and connected in series for providing defined current of $I_b$ for a time life of $t_b$; and means responsive to said battery means in said housing means for providing a regulated voltage output $V_E$ to said processing means for a defined period of time $t_E$ and desired amount of current $I_E$ where:

$$N = \frac{V_E \times t_E \times I_E}{V_b \times t_b \times I_b}$$

4. A method for matching the number of batteries required for a defined operating period of time for the electronic circuits of a self-contained down hole tool where said electronic circuits require a regulated operating voltage and have defined current requirements comprising the steps of:

establishing a first product quantity of the regulated voltage, time of operation and current requirements of the electronic circuits;

establishing the number of individual batteries required at a given D.C. voltage, time life and current output for providing a second product quantity of the given voltage, time life and current output of the batteries where said second product quantity is substantially equal to said first product quantity, coupling the established number of batteries to the electronic circuits of the downhole tool that senses a downhole parameter in a well bore;

drawing output current from said established number of batteries and establishing a regulated operating voltage to the electronic circuits; and thereafter, drawing output current from said established number of batteries as necessary for operation of said electronic circuits while maintaining the regulated operating voltage to the electronic circuits for the time of operation so as to fully utilize each of the individual batteries to its rated voltage/current/life capabilities.

5. A method for utilizing a down hole oil tool having means for sensing a down hole parameter in a well bore and down hole circuits comprising the steps of:

inserting a number N of individual D.C. battery means in the tool, each battery means having a voltage/current/life capability represented by a voltage $V_B$, a current rating $I_B$ and a time life tb for providing electrical power to said downhole circuits where the downhole circuits in said tool require a regulated voltage $V_E$ for a time $t_E$ and draw a current $I_E$ over the time $t_E$ so that the number N of battery means is equal or slightly greater than the relationship of $$N = \frac{V_E \times t_E \times I_E}{V_B \times t_B \times I_B}$$

disposing the oil tool in a well bore for a period of time $t_E$ functionally equated to the time $t_B$ to substantially utilize the available power in the battery means during the time $t_E$; and during the time the oil tool is in the borehole, sensing said down hole parameter.

* * * * *